US006909381B2

(12) United States Patent
Kahn

(10) Patent No.: US 6,909,381 B2
(45) Date of Patent: Jun. 21, 2005

(54) AIRCRAFT COLLISION AVOIDANCE SYSTEM

(76) Inventor: Leonard Richard Kahn, 137 E. 36th St., New York, NY (US) 10016

( * ) Notice: Subject to any disclaimer, the term of this patent is extended or adjusted under 35 U.S.C. 154(b) by 297 days.

(21) Appl. No.: 09/790,103

(22) Filed: Feb. 21, 2001

(65) Prior Publication Data

US 2003/0025614 A1 Feb. 6, 2003

Related U.S. Application Data

(63) Continuation-in-part of application No. 09/503,054, filed on Feb. 12, 2000, now abandoned.

(51) Int. Cl.[7] ..... G08B 21/00

(52) U.S. Cl. ..... 340/945; 340/961; 340/988; 340/980; 702/150; 348/61; 348/82; 348/143; 348/144; 348/39; 345/7; 359/400; 359/399; 359/630

(58) Field of Search ..... 340/988, 961, 340/996, 506, 980, 815.4, 945; 701/200, 301; 702/150; 348/61, 39, 82, 148, 143, 144–147; 359/630, 430, 399, 400, 407; 345/7

(56) References Cited

U.S. PATENT DOCUMENTS 4,322,726 A * 3/1982 Collier et al. ..... 345/7
4,918,442 A * 4/1990 Bogart, Jr. ..... 340/961
5,296,854 A * 3/1994 Hamilton et al. ..... 340/980
5,601,353 A * 2/1997 Naimark et al. ..... 353/122
5,646,783 A * 7/1997 Banbury ..... 359/630
5,647,016 A * 7/1997 Takeyama ..... 382/103
5,717,392 A * 2/1998 Eldridge ..... 340/996
5,815,411 A * 9/1998 Ellenby et al. ..... 702/150
6,046,689 A * 4/2000 Newman ..... 340/996
6,100,921 A * 8/2000 Rowley ..... 348/81
6,246,320 B1 * 6/2001 Monroe ..... 340/506
6,275,773 B1 * 8/2001 Lemelson et al. ..... 701/301
6,366,212 B1 * 4/2002 Lemp ..... 340/815.4
6,369,942 B1 * 4/2002 Hedrick et al. ..... 359/430

* cited by examiner

*Primary Examiner*—Benjamin C. Lee

(57) ABSTRACT

An aircraft collision avoidance system utilizing video signals of the air space surrounding the aircraft for determining whether an object, such as another aircraft, is too close. Use is made of various types of monitors to display the on coming object and its location relative to the protected aircraft. An audio alarm is provided for alerting the pilot of the danger as well as providing localization information. Video recordings store information for accident and near miss studies. The video signals can also be used for the entertainment of airline passengers. One preferred embodiment of the invention permits ground based experts to point out interesting objects that are visible due to the improved view provided passengers.

6 Claims, 9 Drawing Sheets

FIG. 6 (Aft location of projectors not shown.)

AIRCRAFT COLLISION AVOIDANCE SYSTEM

NOTICE OF RELATED APPLICATIONS

This is a continuation-in-part of patent application Ser No. 09/503,054, filed Feb. 12, 2000, now requested to be abandomed.

FIELD OF THE INVENTION

The instant invention is an aircraft safety system for alerting pilots of the presence of objects that may cause a collision. Another embodiment of the invention records information that may be used for investigating accidents and also "near-miss" incidents. Yet another embodiment of the invention provides entertainment for airline passengers.

BACKGROUND OF THE INVENTION

Collision avoidance systems have a long history. Mr. J. B. Minter, in his U.S. Pat. Nos. 5,506,590 and 5,223,847, describes one of a number of Pilot Warning Systems. Mr. Minter, in these two patents, points out that it is the primary responsibility of the pilot to avoid midair collisions. He makes it clear that while the Federal Aviation Administration (FAA) maintains radar and communications systems in order to advise pilots of the presence and location of aircraft in their immediate vicinity and advise pilots how to avoid the danger of a collision, it is up to the pilot to take the proper evasive action.

Mr. Minter also teaches the importance of passive systems that avoid increasing the serious congestion of the radio frequency channels used for radar systems, including widely used aircraft transponders, especially near major airports. Accordingly, his '590 and '847 Patents disclose ingenious passive warning systems.

The publication "Cockpits of the Future; Improving Control," http://www.letstindout.com/subjects/aviation/rfifutur.html copyrighted in 1998 by Knowledge Adventure, Inc. describes future airliner flight decks stating that they would look like the control panels of science fiction movie spacecraft. It points out that the new technology would permit bad weather landings, thus avoiding huge costs and passenger inconvenience. It also opines that "situational awareness" requires two main parts; enhanced vision and synthetic vision. The publication further remarks that the enhanced vision is to make use of a variety of sensors to see through darkness, rain, hail, snow and fog, thus permitting the pilot to see as if it were a clear day. Furthermore, the typical system would include radar, infrared cameras and lasers and the display would be a "head-up-display" wherein the representation of the outside world is projected onto a "see-through" screen in front of the pilot. The synthetic vision, which would use significant computer power, generates a cartoon-like video picture of the outside world integrating information from the navigation system, enhanced vision centers, and data banks in the computer. The image would also provide runways, towns, cities, buildings, hills, rivers and even power lines in the three-dimensional picture. The system would also provide improved navigation by use of the global positioning system (GPS) satellites as well as data from other sources for more accurate, almost blind landings.

Finally, the document mentions the potential use of the microwave landing system, also being introduced, that will permit curved path runway use, accommodating landings from different directions.

U.S. Pat. No. 5,631,640, awarded to D. L. Deis and R. M. Gjullin, assigned to Honeywell, discloses a method of protecting aircraft by using a number of types of sensors, including radar and laser types to rapidly evaluate a situation and to, if there is sufficient time for the pilot to react, alert him of the danger. On-the-other-hand, if there is insufficient time, the system initiates automatic evasive actions. The instant invention discloses equipment that will greatly speed up a pilot's reaction to such a threat, thereby reducing the importance of automatic equipment. Nevertheless, occasions can arise where the quickest human reaction is too slow and therefore the automatic control disclosed in the '640 Patent would be most useful. Accordingly, for certain applications of the instant invention, the method of U.S. Pat. No. 5,631,640 would be utilized, and it is therefore included herein by reference.

Colision avoidance techniques have a long history; for example, U.S. Pat. No. 3,851,334 issued on Nov. 26, 1974, assigned to the U.S. Navy, treats a colision avoidance method wherein the direction and bearing between two aircraft is determined by interrogation of the aircraft. This requires transmission between the two aircraft and, accordingly, is an active system requiring spectrum utilization.

The instant invention discloses new and novel equipment that will permit extremely rapid response to conditions that may cause a collision. It is based upon what has been recently called "virtual reality," a concept of extending the capability of people, especially their vision and strength. Of course, history records many major steps in human enhancement such as the mechanical lever and the telescope. Recent science fiction novels have included excellent descriptions of virtual reality. For example see; "Virtual Destruction," K. J. Anderson and D. Beason, 1996, Berkley Publishing Group, New York, for an interesting description of the use of visual sensors to obtain a birds eye view of remote locations.

The present invention makes extensive use of such "birds eye" vision to provide a practical collision avoidance system as well as a passenger entertainment system. It achieves these goals by the use of practical equipment that not only can be installed in new aircraft, but also in existing aircraft.

The preferred embodiment of the instant invention is also, as is true of the Minter inventions, a completely passive warning system. Video signals of such potentially problem aircraft may be compared with computer stored images of various aircraft in present use. Once the model of the aircraft is determined, its dimensions can be used to ascertain how close the observed aircraft is and whether or not evasive procedures should be initiated. Also, once the aircraft is identified, its rated cruising speed can also be factored into the determination of whether the situation is dangerous and just what evasive tactics should be followed.

Another advantage of the system is that video recordings may be made for use in any accident analysis and also to provide information for "near miss" studies.

One configuration of the invention would require the mounting of a video camera on the top of a wing or the fuselage, and a second video camera mounted on the bottom of the fuselage or a wing. These cameras would, during flight, constantly "look" at respectively the upper and lower hemispheres surrounding the aircraft.

Recordings of the cameras' outputs would be made for future examination to locate near misses and other potential problems and, if, unfortunately, an accident took place, they could be used to analyze the cause of the accident. In order to minimize the requirement for video storage for long flights, record and erase procedures, storing only information necessary for later analysis as disclosed in L. R. Kahn U.S. Pat. No. 4,227,052, may be adopted in embodiments of the instant invention.

The output of the cameras would also be continuously analyzed during flight so as to identify other aircraft and even birds that might create a collision. Aircraft identification is of importance because if a plane is identified its dimensions would be known and from the dimensions the distance of the plane to the protected aircraft could be calculated. Once the computer analysis indicates the aircraft is too close or is on a route that requires aircraft avoidance, an alarm would be sounded alerting the pilot.

The preferred embodiment of the collision avoidance system uses a surround sound stereophonic system. Thus, when the alarm is sounded the pilot would, almost instantaneously, look directly towards the aircraft that was approaching the protected aircraft and quickly initiate avoidance procedures. Since conventional aircraft do not permit the pilot to see all directions surrounding the aircraft, the instant invention provides an artificial visual bubble for vision of the space surrounding the aircraft. It is also possible to use virtual reality displays so that when one turns their head the image around them moves accordingly. Thus, by wearing special goggles or glasses with separate monitors built into each lens, as the pilot's head turns, the display shifts, providing a simulated full two hemisphere vision capability. In other words, a form of what might be called "virtual surround-vision" is provided.

Under poor visual conditions, and at night, the system would use very sensitive night vision infra-red and other type cameras.

SUMMARY OF THE INVENTION

In one embodiment of the invention the pilot of a protected aircraft is alerted to the danger of collision by an alarm sound burst, whenever an object is sensed to be too close to the protected aircraft. Furthermore, the pilot's perception of the location of the sound is such as to cause the pilot to look towards a menacing object as displayed on a monitor system. The instant improved aircraft collision avoidance system would incorporate the following types of equipment or their equivalents:

(a) one or more optical lenses feeding one or more video cameras, said lens or lenses located so as to "see" at least a substantial part of the space surrounding the aircraft permitting the viewing of other aircraft and other objects close enough to the protected aircraft to represent a potential hazard, (b) a monitoring system fed by video signals generated by as the (a) video camera(s), said monitor system arranged so as to cause potentially hazardous objects to appear at a location where the object would be expected to collide with the protected aircraft, (c) circuitry also driven by the signal derived from the (a) cameras for sensing the presence of dangerous objects that are perceived to present a hazardous situation, and (d) audio circuitry driven by the (c) sensing circuitry for producing an alarm sound whenever an object is close enough to the protected aircraft to require evasive actions is sensed, said alarm sound emitted by a surround sound system so as to cause the sound to be perceived by the aircraft's pilot to be at a location where the dangerous object can be seen by the pilot on the monitor system.

Another embodiment of the instant invention can be used for the entertainment and education of airline passengers by feeding the above described video outputs of the (a) cameras to a monitor system, available for use by passengers, so that they can see important landmarks as the aircraft passes over them.

A pending application, L. R. Kahn, Ser. No. 08/773,282 filed Dec. 24, 1996 discloses an electronic reading machine having eye control which may used to assist visually impaired individuals in "reading" printed documents. That invention, unlike the instant invention, requires the user to hold his head relatively steady, but some of the hardware and software is similar for certain embodiments of the instant invention. For example, the four speaker arrangement for producing an acoustical display of a printed text can be used as part of an embodiment of the instant invention. Likewise, multi-speaker earphones and the related control circuitry described in the application Ser. No. 08/779,282 can be utilized in the instant invention. Additionally, the application Ser. No. 08/779,282 treats a number of novel visual display devices that may also be useful in embodiments of the instant invention.

DESCRIPTION OF THE INVENTION

Figure 1:
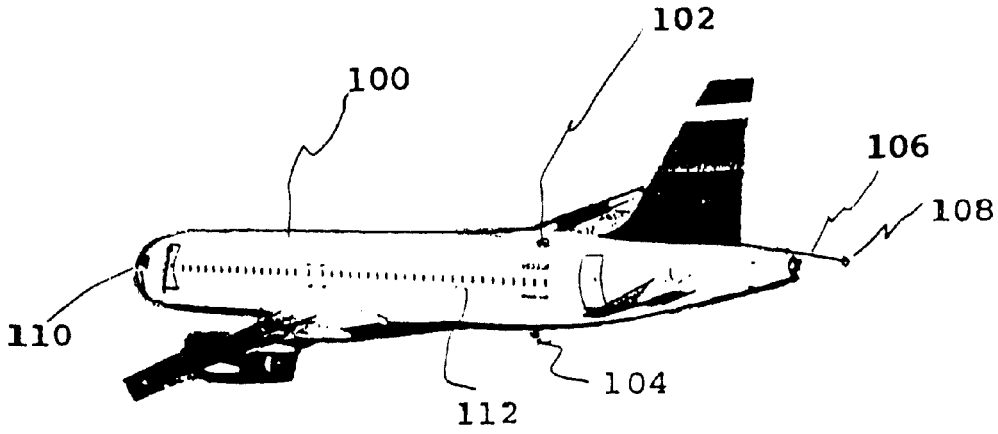
FIG. 1 is the outline drawing of an aircraft showing possible location of optical lenses that will permit the system to "see" at least a substantial part of the space surrounding the aircraft.

FIG. 1 is an outline drawing of an aircraft showing the possible location of lenses that may be used to obtain various views of the aircraft's surrounding space. The aircraft 100 outlined is a 162 seat Airbus 320. Lens 102, mounted on the top of the fuselage, is capable of viewing at least a substantial portion of the hemisphere above the aircraft and lens 104, mounted on the bottom surface of the fuselage, is capable of viewing a substantial part of the hemisphere below the aircraft.

Another suitable lens that may be used to view an appreciable part of the space surrounding the aircraft would be 108, which would be mounted on retractable arm 106. Arm 106 would incorporate fiber-optic cable to couple lens 108 to a video camera interior to the aircraft. Of course, a miniature video camera could be included in the exterior mounting, but the severe environmental conditions strongly favor the illustrated arrangement. Lens 108, in addition to using it in the instant aircraft avoidance system, could also be used to view the landing gear and other external parts of the aircraft during flight.

Externally mounted lenses installed on existing aircraft may present significant aerodynamical problems and require recertification. Therefore, their installation would be an expensive undertaking. Whereas, mounting lenses and miniature video cameras on appropriate inner surfaces of the aircraft's windows and combining the views of these cameras is, in most situations, far superior. For newly designed aircraft externally mounted lenses may prove to be superior under certain conditions.

Figure 2:
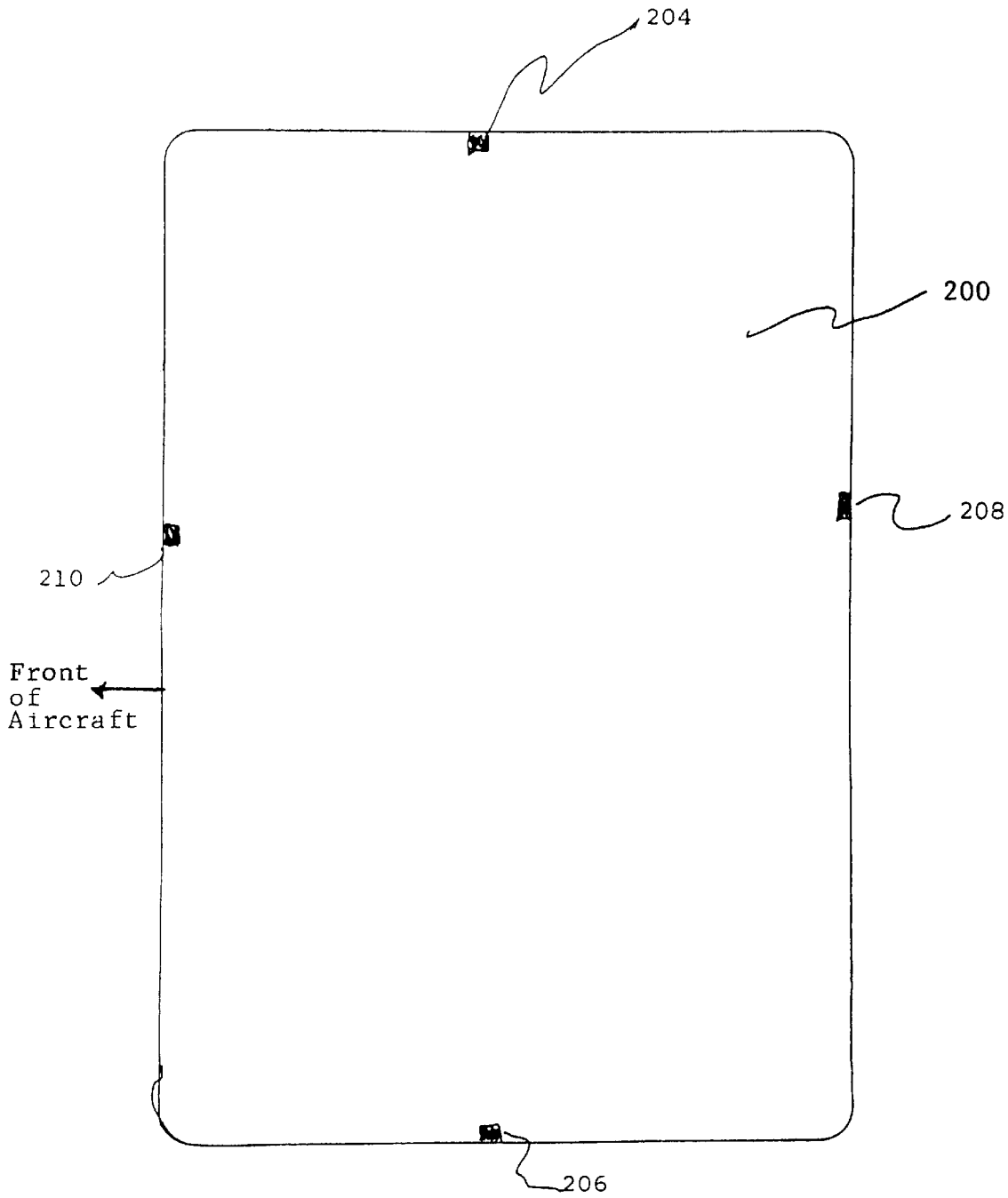
FIG. 2 shows how video cameras may be mounted on the windows avoiding the various problems of external mounting of optical lenses and video cameras on the outside of the aircraft.

FIG. 2 shows a typical passenger window with video cameras affixed at a number of locations. The locations provide different views and all are located at the perimeter of the window to avoid, as much as practical, interference with passengers' views. Assuming the window is small and it does not have substantial curvature to avoid visual interference from the lip of the window camera 204 should "look" at the space below the aircraft and camera 206 to the space above the aircraft. Conversely, if the window has substantial curvature in its vertical dimension, the cameras' view would be best reversed.

Similarly, camera 208 would look to the space in front of the aircraft and camera 210 to the aft, if there is little curvature in the horizontal dimension of the window. As a practical matter, the installation of more than one camera on a window would minimize installation time and permit multiplex circuitry to transmit the video outputs to an appropriate utilization point on the aircraft.

For typical large airline aircraft, probably video cameras would be located at both sides of the plane, a few rows behind the wings, so as to avoid interference of the view by the wings. Another set of video cameras would be mounted at both sides of the plane furthest aft of the plane to "see" the airspace behind the aircraft. Finally, some four cameras should be mounted on the cockpit windows 110 of FIG. 1.

When an object is sensed to be too close, an alarm is sounded. It is a feature of a major embodiment of this invention that the pilot be immediately provided information to permit evasive action to be initiated. Such action requires knowledge of the approximate location of the potentially impacting object. A special surround sound system is required to promptly provide said knowledge.

One embodiment of the invention that would provide location information would use special earphones which are disclosed below. It is also possible to use loud speakers positioned at various parts of the cockpit to also implement the system.

The alarm sound may be very short in duration, a few tenths of a second. If such a short sound burst is used with the earphone embodiment, it is unnecessary to provide any equipment for tracking the direction towards which the pilot is turning his or her head. Of course, if the alarm is of longer duration the audio sound must be corrected for the direction towards which the pilot, using earphones, turns his head.

Figure 3:
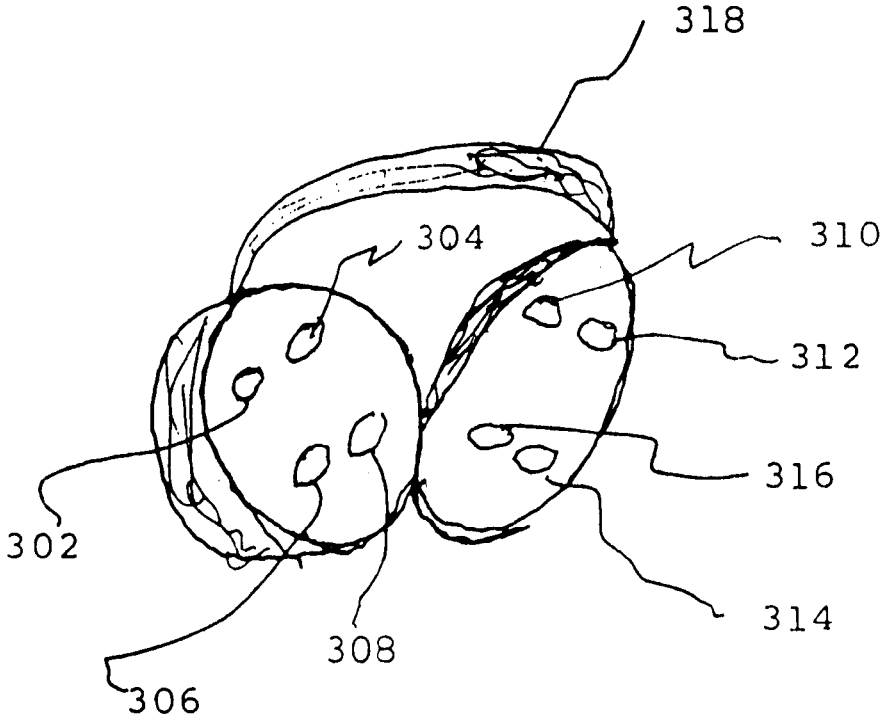
FIG. 3 illustrates special earphones that can provide a form of surround sound that may be used to alert the pilot of where to look for the potentially dangerous approaching object.

FIG. 3 illustrates an earphone version of the invention that utilizes eight small speakers; four of which, 302, 304, 306, 308 are mounted in the left earphone housing, and the other four, 310, 312, 314, 316, in the right housing. The top speakers 302, 304 and 310, 312 permit localization of the alarm sound in the upper sound hemisphere. The lower four speakers permit localization in the lower hemisphere.

Figure 4:
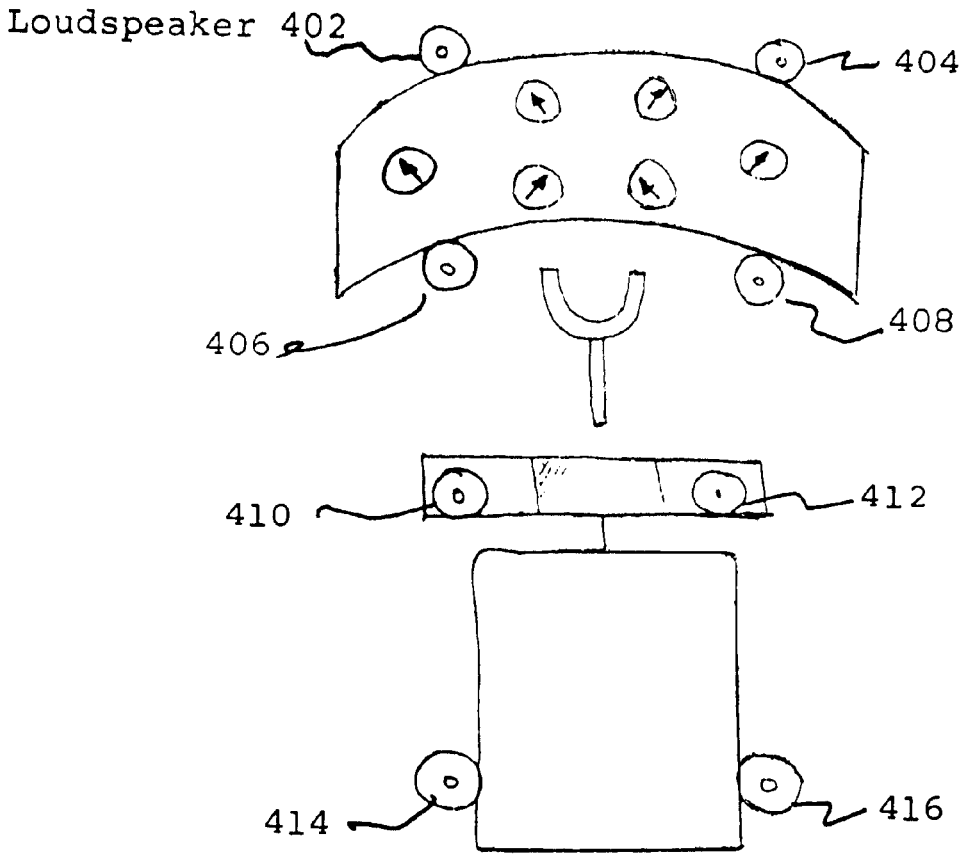
FIG. 4 shows an eight loudspeaker arrangement for implementing the surround sound system which may be used as an alternative to the FIG. 3 earphone unit.

FIG. 4 illustrates an alternative embodiment of the invention wherein a set of eight speakers are used to provide the alarm signal localization information. The speakers are mounted at various locations surrounding the pilot. The speaker embodiment requires no compensation for motion of the pilot's head, no matter how long the alarm is sounded. A paper entitled "A Multiple Microphone Recording Technique for the Generation of Vertual Acoustic Images", by Yuvi Kahana, et.el., was recently published in J. Acoust. Soc. Am. 105(3), March 1999. This paper provides interesting experimental data regarding sound localization which is an element of one embodiment of the instant invention.

Besides using miniature monitors mounted on eyeglasses, the simulated view of the optical sphere surrounding the aircraft can be provided by use of a multiplicity of monitors surrounding the pilot. Unfortunately, such a procedure would be impractical for use in existing aircraft. However, a multi-monitor system using projection type displays, (FIG. 6), such as used for television applications, provides a solution. The images can be projected along the walls, ceiling and floor of the cockpit. Such an arrangement would also integrate the normal vision provided by the windows of the cockpit into the complete spherical display.

Figure 6:
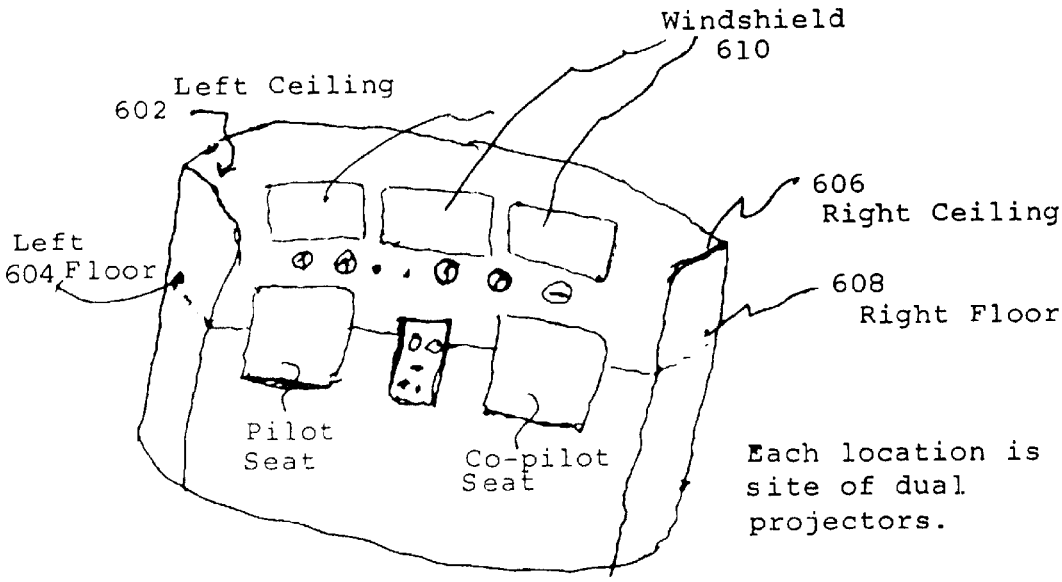
FIG. 6 illustrates a projection system for projecting the video images of the space surrounding the aircraft on the walls, ceiling and floor of the cockpit using 16 projectors. It should be noted that a lesser number of projectors may be used to take account of the excellent vision afforded by cockpit windows and also because the expected dangerous objects are generally large enough to be seen even if part of the space surrounding the aircraft is not visible.

For example, the space surrounding the aircraft can be simulated in the cockpit by as many as sixteen projectors (as illustrated in FIG. 6) or as few as two wide angle projection displays plus the vision through the normal cockpit windows. Furthermore, the cockpit windows can use the above mentioned "see-through" screen to cover a part of the simulated view. It would be advantageous to have the vision of the hazardous object blinking at high intensity to best attract attention.

It is obvious that there are no hard and fast rules as to the proper number of projectors to be used and their location. Designers of cockpits, knowing their exact layouts and how airline personnel position themselves, etc., are clearly in a far better position to make such case by case decisions.

Figure 5:
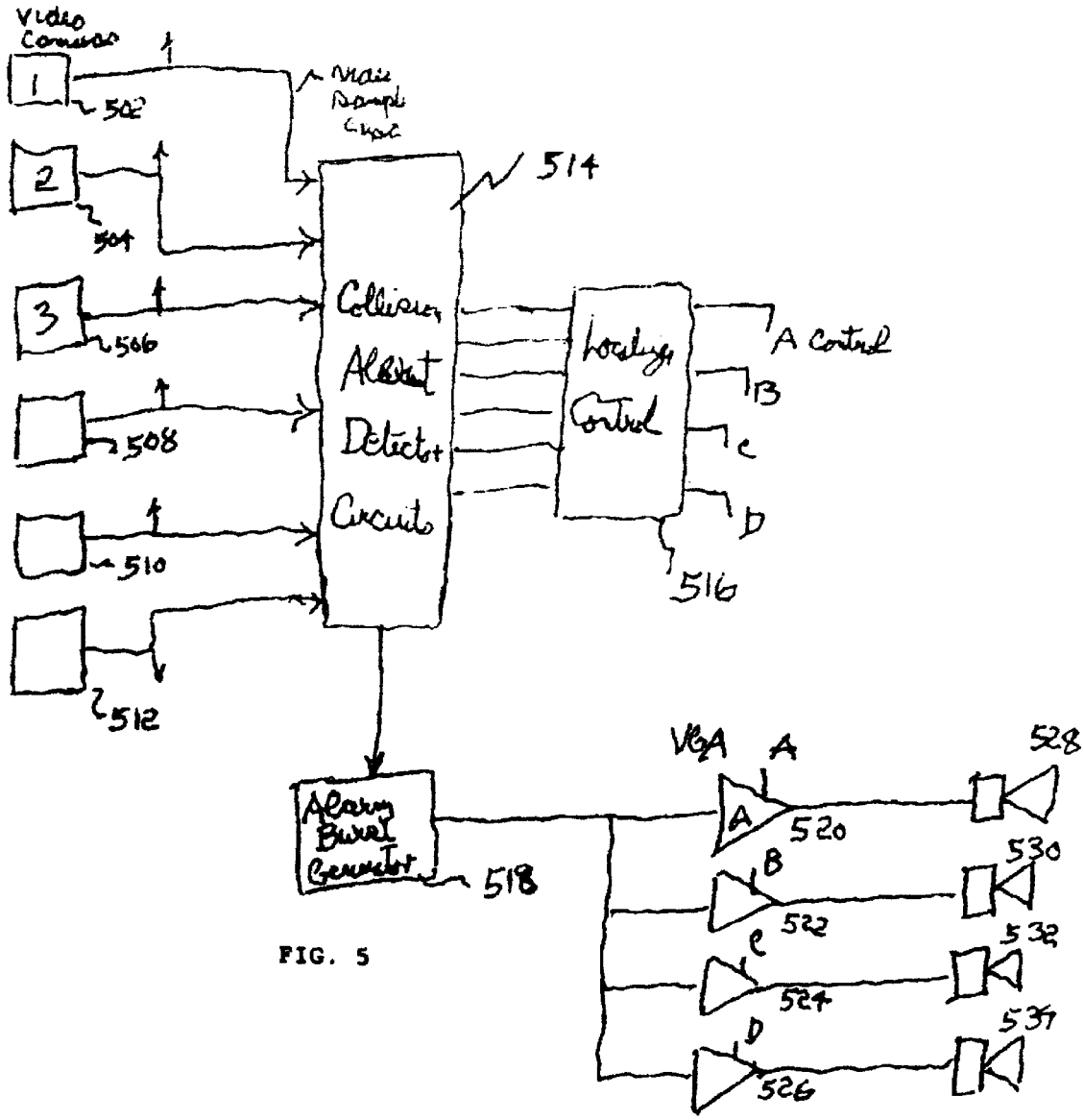
FIG. 5 shows in block diagram form an electronic speaker/earphone control circuit.

FIG. 5 shows, in block diagram form, a control circuit for providing localization information with either multi-speaker or earphone equipment. By varying the amount of audio power fed to individual speakers the pilot will be alerted as to which direction to look for the approaching hazardous object. As is pointed out in Kahn application Ser. No. 08/773,282, a properly implemented four speaker arrangement gives a two dimensional stereophonic illusion that can pinpoint sound location in a defined frontal area. By augmenting a four speaker arrangement in front of the pilot with four speakers behind the pilot, the space surrounding the pilot can be accommodated. With the four speaker earphones of FIG. 3 and with controls that compensate for the user's head motion, only four are necessary, even though a full eight speaker headset is superior.

FIG. 5 shows how such a system can be constructed with conventional audio and video devices. Samples of the output of, for example, six video cameras; 502, 504, 506, 508, 510, and 512 are fed to the Collision Alert Detector Circuits block 514. In its simplest form, Block 514 incorporates a video detector for each camera sample for sensing the sudden appearance of a potentially dangerous object. The sudden change of video content causes two events to occur; 1) an alarm burst is generated by Generator 518, and 2) Localizer Control circuit 516 produces control voltages that in turn varies the gains of variable gain amplifiers 520, 522, 524 and 526 to produce the correct audio power to speakers 528, 530, 532 and 534 so as to provide the proper localization of the alarm sound.

If a large number of video cameras and video monitors are used to cover the space surrounding the aircraft, the control system meed only locate the alarm sound in the general location of the activated camera, as the normal peripheral vision of the pilot will permit him or her to locate the threatening object. However, if a small number of wide-angle cameras are used as illustrated as 102 and 104, or even wider angle 108 of FIG. 1, then additional control processing is required. In such embodiments, the collision alert detector circuits of 514, provide information as to the location of the object beyond just which camera is active. This can be accomplished by using the vertical and horizontal sync signals to calculate the location of the detected object's x,y coordinates. The coordinates can then be fed to the localizer control 516 which in turn provides the control voltages to the variable gain amplifiers causing the two dimensional stereo speaker system to pinpoint the stereo image.

FIG. 6 illustrates the cockpit display system utilizing projection type monitors.

An essential element of the collision avoidance embodiment of the instant invention is the audio alarm to alert the pilot to hazardous situations. Without such an alarm one cannot rely upon any human being to remain alert and watchful for such emergencies during long flight periods, no matter how many monitors are available.

In its crudest form, the alarm would be a piercing loud sound that would cause the pilot to immediately become aware of danger, even if he or she were dozing. A far better implementation would be to have the individual not only alerted to the danger, but provided information that would cause the pilot to immediately look towards the danger so as to best take evasive actions. Thus, the collision avoidance embodiment of this invention requires integration of a spacial alarm system with a birds eye view of the space surrounding the aircraft showing any hazardous objects. And, most importantly, the alarm should cause an almost instantaneous instinctive response that will safeguard the aircraft.

It is common practice for airline pilots to point out interesting locations that can be viewed from aircraft windows. Using the artificial visual bubble derived from video cameras, a dramatic improvement over viewing landmarks through normal aircraft passenger windows is provided. Indeed, a fully implemented version of the new equipment can achieve the illusion of sitting in a glass bubble, able to look at all locations surrounding the plane. Of course, the system can be implemented with the same identical equipment as the pilot uses for collision avoidance, but since the passenger is not required to hold their hands towards the front of the cockpit to control the aircraft, the "birds eye view" can be achieved by merely adjusting a hand held control capable of providing the entire view. And, of course, there is no need for the special sound alarm.

This entertainment embodiment of the invention may be automated by utilizing aircraft location equipment to control prerecorded descriptions of notable landmarks. Furthermore, when high precision location information is available, this information may be used, not only to focus on landmarks, but to zoom in on them. This service to passengers may be provided at no cost or may be provided to only passengers that wish to utilize the service. If the latter procedure is followed the computer can be used to store information so as to properly bill the passenger for the services received.

Figure 7:
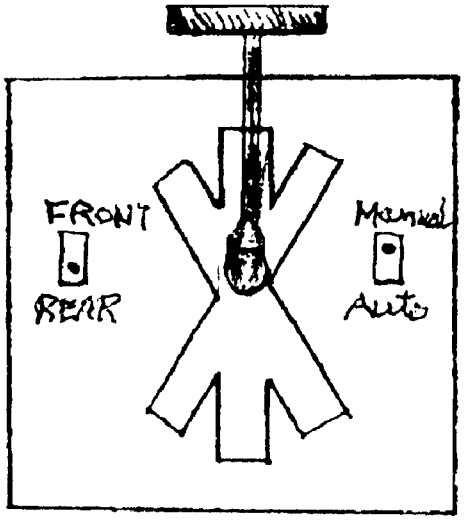
FIG. 7 shows a "joystick" for permitting airline passengers to control video views of landmarks, etc.

The entertainment embodiment of the instant invention provides passengers with a number of views of the space surrounding the aircraft. As an example these views may be segmented into the following nine front views, (and by use of a "rear switch" nine additional rear views may be utilized):

1) Straight ahead horizon
2) Straight ahead up
3) Straight ahead down
4) Right horizon
5) Right up
6) Right down
7) Left horizon
8) Left up
9) Left down Thus, there are nine positions that would cover the passenger view of the front space surrounding the aircraft. To comfortably cover the space behind the aircraft, one would have to turn their seats around to face the rear (aft) of the aircraft. This procedure can be simulated by merely having the passenger press a button to reverse his or her view. Such a control would be most suitably added to a manual joystick as shown in FIG. 7.

Figure 8:
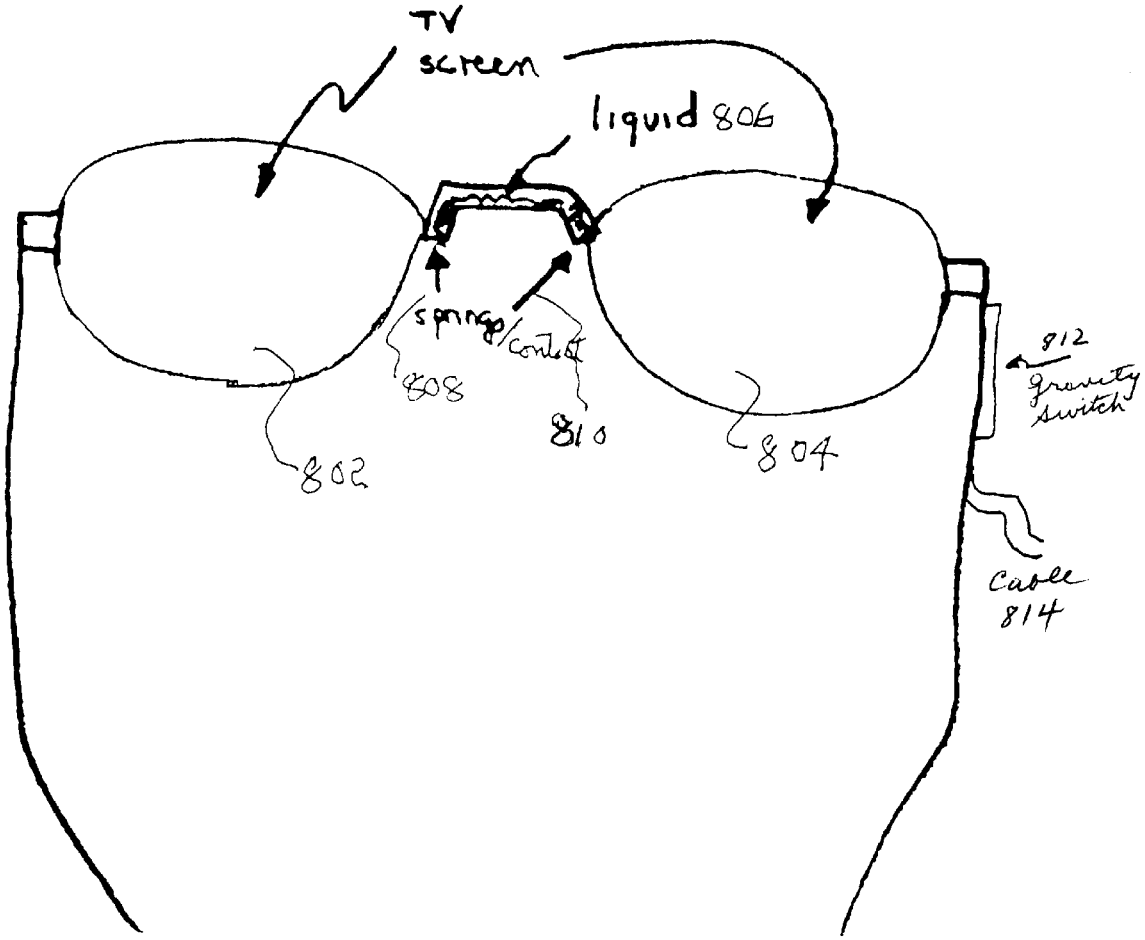
FIG. 8 illustrates eyeglasses specially constructed for monitoring video images and equipped to sense the motion of the user's head.

Control can also be achieved automatically with the special eyeglasses, FIG. 8, with monitor screens on both the left and right lenses. These eyeglasses can also sense head motion. For example, a gravity type switch can determine up, down and straight ahead positions of the passengers head. Furthermore, left and right motion can also be accomplished by use of a thin hose mounting along the frame of the glasses partially filled with a liquid so that when the passenger turns his head in a normal, fairly rapid motion, the inertia of the liquid will cause a spring contact to close, indicating that the head has been turned to the right. Conversely, when it is turned to the left a spring on the other end of the tube will be caused to close a second contact. Latching circuits are used to store the information re the direction the passenger last turned his or her head.

That stored information, plus the information re up, down or level position, derived from the gravity switch provides the required head position status.

As an alternative to determining head motion by use of special sensors in eyeglasses, a seat cushion equipped with sensors can be used. As seated individuals turn their heads their center of gravity shifts causing a change in the pressure they assert on their seats. Thus, the cushion illustrated in FIG. 9 will have increased pressure on sensor points 902 and 904 if the individual looks towards the left and increases sensor points 906 and 908 when looking towards the right direction. Similarly, when the individual looks down, the pressure increases at points 902 and 906. Finally, combined motions such as looking down to the right will assert greatest pressure on 906 and looking up on the left will maximize pressure on 904.

For individuals with physical abnormalities, and/or poor posture that influences their centers of gravity, changes in averaged pressures will permit use of the cushion. Such average measurements might be made during the announcement instructing passengers how to make use of the vision enhancement equipment.

If the entertainment embodiment of the invention is to be used solely for viewing landmarks, eschewing views of birds and high mountain peaks, etc., then a considerable simplification of passenger equipment and complexity of operation is available. For example, the gravity switch in the eyeglass control can be eliminated as can the rear pressure cushion points 904 and 906 of FIG. 9.

An important advantage of the entertainment and educational application of the instant ivention is that it can be used to encourage night time flights when airports and the airlanes are underutilized.

Thus, one embodiment of the instant invention would permit passengers to attend lectures on astronomy during flights. Under normal conditions, it would not be feasible for an airline to carry an astronomer to conduct such lectures. However, the disclosed system permits the use of "stay-at-home" astronomers to give lectures and to even answer questions concerning stars and other celestrial bodies that passengers "point to."

To accomplish this goal, the astronomer must view the star-map appropriate for that specific location of the aircraft and the star-map must be lined up with the video display on the aircraft as seen by the passengers. Thus, to line up the ground based star-map with the aircraft's view of the sky, it is necessary to provide the ground location with information re; a) the location of the aircraft, and b) at least the coordinates of one star or planet. Knowing the location of the aircraft permits a proper selection of a star-map and the coordinates of one or more key stars or planets can be used to correct for the direction, heading of the plane.

The coordinate information must be continuously transmitted, or at least frequently updated so that the ground based star-map may be shifted in position to conform to aircraft changes in location and headings.

In an alternative embodiment of this invention, rather than sending coordinate information to the ground based expert's computer, the location and bearing of the aircraft can be transmitted to the ground and that information fed to the expert's computer or another centrally located computer. Such computers, with access to the necessary astronomical and terrestrial charts and maps, can provide the information to line up the experts' displayed charts and maps.

In order to personalize lectures, each student/passenger could be identified by not only seat number, but also by name. Thus, when a passenger wishes to ask a question he or she could push a button or just speak energizing a speech activated circuit and their seat location and name would be displayed on the expert's monitor.

During the lecture, the astronomer would naturally wish to direct the passengers to particular celestial bodies. This can be accomplished by transmitting up to the aircraft the coordinates of location of the bodies so that the monitor screen "blinks" with high intensity at the desired point. Alternatively, coordinates can be transmitted to control an electronic pointer.

Furthermore, by use of a touch screen, mouse or other equivalent device, passengers can point to celestial bodies which they want discussed. In order for other passengers to follow the discussion, all passenger monitors would be configured to display the electronic pointer.

An important improvement over the touch screen, and other hand-operated devices, would be to utilize eye controlled devices. Devices to sense the direction toward which an individual is looking are well known in the patent literature as discussed below, While the accuracy of present eye control technology is limited, as a practical matter their accuracy may be sufficient for normal passenger usage. The average passenger will be interested in asking questions about only a limited number of celestial bodies; such as, bright sister planets and well known objects such as the Big Dipper, etc. Therefore, the lecturer can deduce from the general direction the passenger is looking towards which body he or she is interested in.

It should also be noted that the disclosed cushion control will alleviate one of the main sources of inaccuracy in applying eye control devices. Providing passengers with a birds eye view of the sky, whereby they can raise their "visual horizons," substantially increases the resolution of eye direction sensing devices. The improved central vision of human beings, as further limited by their eye lids, permits them to discriminate between substantially more points when viewing points on their visual horizon. Thus, the devices shown in FIG. 8 and FIG. 9 significantly improve the performance of the eye direction sensing mechanisms referenced below.

This overall procedure, of course, requires ground-to-air and air-to-ground communications circuits. However, because only coordinate information of a few points is transmitted, the required bandwidths of the circuits are modest.

This equipment can also be used with ground based tour guides acting as experts. These tour guides would identify buildings and other points of interest as the aircraft flies over tourist type areas. For example, when flying over Hollywood or Las Vegas, ground based tour guides could point out movie stars' estates and even "zoom in" on them. Especially interesting and educational would be "birds eyes" lectures during flights over the Grand Canyon, and the Florida Keys.

It should be stressed that the astronomer, recognizing that the vast majority of questions that the average lay passenger will raise will be limited to a few well known celestial bodies and very bright objects, does not require precise locations. Even if the location is derived from the cushion mounted sensors of FIG. 9, the astronomer can deduce, in most cases, which body questions pertain to.

Furthermore, even if the astronomer has only a general idea of where the passenger is looking, the lecturer can proceed as for example: "Passenger Johnson is looking towards the Big Dipper and I am now using my electronic pointer to circle around the entire Big Dipper and I am now pointing to the North Star. The North Star has been used throughout recorded history for navigation along with the Sun during daytime to determine latitude. Indeed, the Vikings are believed to have travelled to America some 500 years prior to Columbus by following a constant Latitude Navigation procedure, keeping the North Star and the Sun at constant angles above the horizon."

Figure 9:
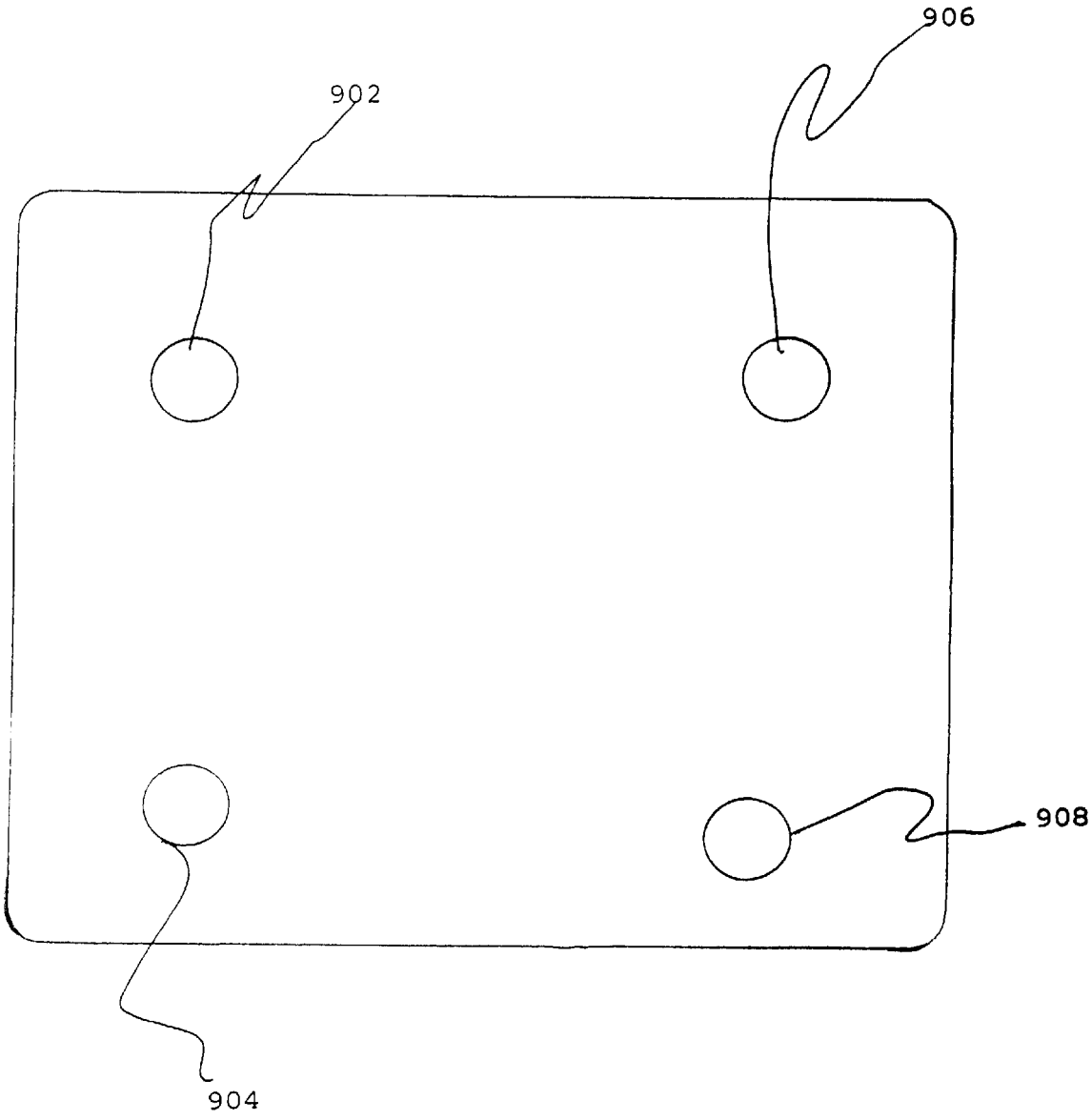
FIG. 9 illustrates a cushion with special sensors to detect the motion of an individual's head.

Thus, except for exceptional cases the cushion of FIG. 9 and/or the eye glasses of FIG. 8, will provide adequate information as to which celestial body the average passenger is looking. (If the passenger happens to be an astronomer, he or she should be able to identify the body by name or other means of identification.) On the other hand, the astronomer/lecturer would normally be expected to use a manually controlled pointer in conducting the lecture.

On the other hand, as the public becomes more interested in astronomy due to space exploration, more celestial bodies may interest the average airline passenger. In that event the use of eye direction sensors, as per technogy disclosed in the following prior art United States patents which are incorporated herein by reference:

U.S. Pat. No. 4,109,145 issued on Aug. 22, 1978

U.S. Pat. No. 4,595,990 issued on Jun. 17, 1986

U.S. Pat. No. 4,648,052 issued on Mar. 3, 1987

U.S. Pat. No. 4,973,149 issued on Nov. 27, 1990 is required to enhance the precision provided by other means of judging where passengers are looking.

It is of great importance to stress the key advantage of the instant collision avoidance system, its activation of the pilot's basic inborn instinct to almost instantly move away from danger. The disclosed system allows the pilot, as soon as he or she hears the spatially localized alarm to immediately react. Indeed, even if the pilot cannot see the danger there is a reaction to move away from a loud alarm sound. However, actually seeing the object and confirming that it is a danger, provides further assurance of proper pilot response. Thus, if the approaching aircraft is located behind his aircraft it is best that he does not try to turn around and take his hands off the controls but merely look either over his left or over his right shoulder, according to where the alarm was sounded. Once the pilot sees the aircraft coming at him from the back, his natural impulse is to fly his aircraft away from the approaching aircraft. If the pilot has sufficient time, the next reaction would be to follow normal procedures for passing aircraft. Prerecorded messages, controlled by the above described circuitry, can suggest to the pilot appropriate evasive actions.

Thus, an individual's basic instinctive reaction to sudden danger is far more effective than a trained response, such as a result of training to "see" objects on radar displays. Also, if the pilot's response to radar is incorrect, the result can be catastrophic. On-the-other-hand the instinctive reaction to seeing or even just hearing an object about to strike you is to move away from the danger, generally the correct initial avoidance tactic.

Finally, it should be noted that the number of video cameras used in various embodiments of this invention does not necessarily equal the number of monitors. For example, a wide-angle camera mounted on the outside of the aircraft covering most of the space surrounding the plane can be electronically segmented and each segment fed to a separate monitor. On-the-other-hand, the video from a large number of window mounted cameras can be spliced together and fed a lesser number of monitors.

From the above description of the invention it will be obvious to those skilled in the art that designers of the disclosed equipment have a wide range of choices that will influence the cost and complexity of the equipment. For example, the number of video cameras used and the number of views monitored and projected, directly impact on cost. Nevertheless, such decisions may be made without departing from the invention.

Furthermore, while there have been described what are at present considered to be the preferred embodiments of this invention, it will be obvious to those skilled in the art that various changes and modifications may be made therein without departing from the invention and it is, therefore, aimed to cover all such changes and modification as fall within the true spirit and scope of the invention.

What is claimed is:

1. A system for avoiding collisions and recording near miss events and also providing improved vision of the ground for passengers comprising:

(a) one or more optical lenses feeding one or more video cameras, said lens or lenses located so as to "see" at least a substantial part of the space surrounding the aircraft permitting the viewing of other aircraft and other objects close enough to the protected aircraft to represent a potential hazard, (b) a monitoring system connected to the video signals generated by the (a) video camera(s), said monitor system arranged so as to cause potentially hazardous objects to appear at a location where the pilot would expect the object would collide with the protected aircraft, (c) circuitry also driven by the signal derived from the (a) cameras for sensing the presence of dangerous objects that are perceived to present a hazardous situation, and (d) audio circuitry driven by the (c) sensing circuitry for producing an alarm sound whenever an object is close enough to the protected aircraft to require evasive actions is sensed, said alarm sound projected by a surround sound system so as to cause the sound to be perceived by the aircraft's pilot to be at a location where the dangerous object can be seen by the pilot on the monitor system, (e) a video recorder connected to the (a) optical/video system and controlled by the (c) sensing circuitry so as to record the signals fed to the two monitors, and (f) passenger monitoring equipment fed by at least some of the video signals generated by the (a) video cameras, said passenger monitoring equipment arranged so as to permit the viewing of landmarks from individual passenger seats.

2. An entertainment and education system permitting passengers to view celestial bodies and landmarks comprising:

(a) one or more optical lenses feeding one or more video cameras, said lens or lenses located so as to "see" at least a substantial part of the ground below and the sky above the aircraft permitting the viewing of stars, planets and other celestial bodies as well as buildings and other landmarks that passengers might find interesting, (b) a monitoring system connected to the video signals generated by the (a) one or more cameras, said monitoring system arranged so as to view such objects from individual passenger seats, and (c) pressure sensors, upon which passengers sit, for detecting the direction passengers turn their heads to view monitors that display the celestial bodies and landmarks that they may find interesting.

3. Equipment for entertaining and educating airline passengers permitting ground-based experts to describe points of interest to the airline passengers in the sky including transmission facilities to transmit the coordinates of one or more celestial bodies visible on the aircraft permitting an expert's terrestrial sky charts to be lined up with the passengers' view of the sky.

4. Equipment for entertaining and educating airline passengers by providing communications between passengers on the aircraft and ground-based experts permitting said experts to describe points of interest on the ground or in the sky to the passenger; including, transmission facilities to transmit the coordinates of celestial bodies or ground sites as displayed on the aircraft monitors that provides the required information to line up the maps and sky charts used by the experts with the passengers' monitors and facilities to permit passengers to transmit monitor coordinate information to the expert thereby permitting passengers to point to specific celestial bodies and ground sites during lectures.

5. Equipment, including video monitors, for entertaining and educating airline passengers by communicating between aircraft passengers and one or more ground based experts who offer information to passengers regarding points of interest on the ground or in the sky, including facilities to transmit monitor coordinate information thus allowing the expert(s) to direct passengers to a specific location on the ground or in the sky.

6. Equipment for entertaining and educating airline passengers that permits ground based experts to lecture and answer passenger questions, such experts includes at least one of professional and amateur astronomers, wherein equipment is provided for sensing the direction towards which an airline passenger is looking connected to a communications channel to transmit that sensed direction information to a location where it can be viewed by said ground based experts.

* * * * *